United States Patent [19]

Brouwer

[11] 4,000,386

[45] Dec. 28, 1976

[54] FLUID OPERATED ELECTRICAL RELAYS AND SYSTEMS

[75] Inventor: Charles William Brouwer, East Greenwich, R.I.

[73] Assignee: Leesona Corporation, Warwick, R.I.

[22] Filed: June 2, 1975

[21] Appl. No.: 582,696

Related U.S. Application Data

[63] Continuation of Ser. No. 449,110, March 7, 1974, abandoned.

[52] U.S. Cl. ..... 200/83 Q; 200/83 N; 137/119

[51] Int. Cl.[2] ..... H01H 35/34

[58] Field of Search ..... 137/557, 608, 609, 111, 137/119, 636; 251/61.1, 331; 200/243, 292, 303, 83 A, 83 N, 83 Q, 83 V, 81.4, 81.5, 83 B, 83 C, 83 D; 340/164 A, 240; 235/200 R, 200 PF, 201 R, 201 PF, 201 FS

[56] References Cited

UNITED STATES PATENTS

| | | | |
|---|---|---|---|
| 3,267,233 | 8/1966 | Basile | 200/83 |
| 3,689,719 | 9/1972 | Phillips | 200/83 N |
| 3,702,909 | 11/1972 | Kraakman | 200/83 R |
| 3,710,060 | 1/1973 | Brevick | 317/101 CC |
| 3,779,267 | 12/1973 | Cowan | 137/111 |
| 3,789,864 | 2/1974 | Cowan | 137/119 |

FOREIGN PATENTS OR APPLICATIONS

| | | | |
|---|---|---|---|
| 676,140 | 2/1930 | France | 200/83 N |

OTHER PUBLICATIONS

IBM Tech. Discl. Bull., Pneumatic Latch Circuit, Norwood, vol. 8, No. 8, Jan., 1966.

IBM Tech. Discl. Bull., Pneumatic to Electric Transducer, Meier, vol. 6, No. 5, Oct., 1963.

*Primary Examiner*—Gerald P. Tolin

*Attorney, Agent, or Firm*—Burnett W. Norton

[57] ABSTRACT

Low-cost fluid-operated electric relay type logic elements are provided with an elastomeric conductive diaphragm flexed out of a stable taut intermediate position by means of differential pressures of fluid signals directed into respective chambers on opposite sides to provide thereby break or make connections with cooperating conductive contacts. Thus fluid logic, switching circuit logic or hybrid logic operations may be effected directly with attendant advantages of reliability and more powerful logic capabilities. Alternatively the elements may serve as interfacing members to produce electrical signals from fluid systems. The elements have further advantages as servicing monitor means where access is provided to conductive circuits displaying more servicing information relating to operational characteristics of the fluid logic devices than possible with fluid indicators.

10 Claims, 5 Drawing Figures

FIG. 4

FLUID OPERATED ELECTRICAL RELAYS AND SYSTEMS

This is a continuation of application Ser. No. 449,110, filed Mar. 7, 1974, now abandoned.

BACKGROUND OF THE INVENTION

This invention relates to logic control systems and more specifically it relates to fluid logic elements of the taut diaphragm type provided with electrical switching contacts indicating the various logic conditions signified by displacement of the diaphragm.

Diaphragm type fluid logic devices for operation with on-off type digital fluid flow signals are well known in the art. Thus, flip-flop functions are attained as shown for example in Ser. No. 349,635 filed by the common assignee of this invention for Fluid Operated System, now U.S. Pat. No. 3,789,864. Another example is the logic OR device described in Ser. No. 165,446, Fluid Operated Logic Device, now U.S. Pat. No. 3,779,267.

While logic systems incorporating such fluid logic elements are advantageous since they are compact, efficient, inexpensive and operate quickly over a long reliable lifetime, there are some problems presented in fluid systems. One such problem is the R-C time constant effect of fluid flow passage through a long fluid flow channel. This might cause errors in response or timing of some logic elements, and may limit the fluid logic systems to those applications which may be confined within reasonable boundaries of location. Such is not so with electric wires.

Another problem encountered is the interfacing of the fluid applications with electrical systems or load devices such as relays, which otherwise might be used advantageously to improve system performance and flexibility. A simple spring switch assembly might be actuated by flexing a diaphragm to operate the spring in a conventional manner, but this not only is unwieldy and expensive but also interferes with the timing and loading characteristics of the logic element and thus may be incompatible with the system requirements. More important is the fact that this is an indirect indication of fluid conditions which may not exactly follow the behavioral response of the logic element, it diaphragm or the fluid paths controlled thereby.

Another not trivial set of problems is in the cost of electric switch interfacing and mechanical compatibility of switching structure with the fluid logic elements. Thus, for example, the logic elements may require special mounts or structures to accommodate the switches which would be difficult to locate in situ on a machine location or in a compact modular assembly of logic elements.

Further the servicing of fluid logic systems has been difficult, particularly in integrated or modularized complex systems, where it is difficult to isolate operating conditions of individual elements or circuit sections. Some kinds of problems may be sensed by pressure gages at key system junctures to show general operation conditions. However in a complex system, it may become important to isolate problems to a specific element or portion thereof so that an extra unit might be substituted for a defective one without requiring extensive system access. For example the proper seating of a diaphragm on a nozzle is required to seal a flow path. If the path is not sealed the condition may be shown by a pressure gage. However, the position of the diaphragm is not known so the condition causing the lack of sealing may not be evident and the nature of the problem is not isolated because there are no known simple prior art indicators of the diaphragm position or diaphragm wear and operating conditions in dynamnic conditions encountered with fluid logic elements.

Also the general reliability requirement for redundancy, or the provision of certain types of logic patterns may be complex by use solely of fluid logic. For example a logic "not" function is not readily achieved by simple logic elements. An electric transfer switch, however, simply provides either a logic signal or its inversion. Accordingly, the "logic power" of a system confined to fluid logic alone is generally limited in scope and may result in a system more complex than could be attained by logic elements providing more versatile logic functions.

OBJECTS OF THE INVENTION

Accordingly it is a general object of this invention to provide improved fluid logic elements which resolve some of the aforesaid problems.

A more specific object of the invention is the provision of electric circuit continuity interfaces in fluid logic elements that are compatible in operating conditions without loading or changing operating characteristics of the fluid logic performed in such elements.

Another object of the invention is to provide service indications that convey more detailed operating information of the fluid logic elements during dynamic operation thereof.

A further object of the invention is to produce low cost hybrid relays that operate quickly and which may be used efficiently in complex switching and logic systems.

BRIEF DESCRIPTION

The above objectives of the invention are achieved in a preferred embodiment of the invention which provides a hybrid fluid-electric logic relay type element having a taut elastomeric conductive diaphragm held between two chambers of a housing into which may be introduced respectively two fluid signals of different pressure patterns to flex the diaphragm toward at least one of the chambers in response to the pressure differential on opposite sides of the diaphragm introduced in said chambers by the different signals. The housing which contains fluid nozzles or valves operated by the diaphragm also contains conductive contacts which may be intercepted by the diaphragm in either flexed or unflexed position at opposite sides to thereby produce changes in electric circuit continuity either dynamically or statically in response to the input fluid signal conditions which establish the diaphragm position. A system of such elements connected together therefore provides both fluid and electrical circuit logic operating nertworks which can work in a parallel fluid-electric mode or in hybrid fashion to increase the logical capabilities of the system without significant additional expense or complexity.

THE DRAWINGS

Further features, advantages and objectives will be found throughout the following more detailed description which refers to the preferred embodiments set forth in the accompanying drawing, wherein FIG. 1 is a section view in elevation of a cylindrical hybrid fluid-electric relay type logic element provided by this invention;

CONSTRUCTION AND OPERATION OF THE FLUID RELAY LOGIC ELEMENTS

Figure 1:
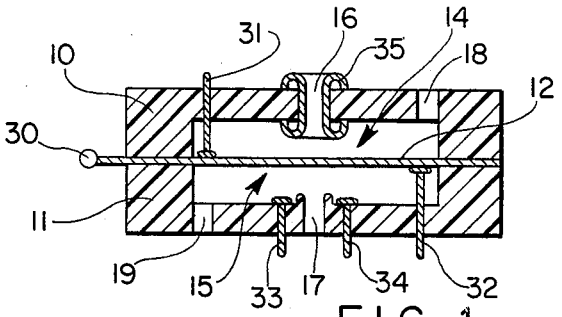

As may be seen in FIG. 1, two housing members 10 and 11 are clamped together by means not shown to hold taut therebetween the elastomeric diaphragm 12. This diaphragm is preferably electrically conductive in whole, in part or by lamination, but can if timing, flexing and load are not deteriorated in some applications carry a conductive member such as a thin metal plate. One type of conductive diaphragm is provided by dispersing essential silver powders in silicone or fluorosilicone binders. These diaphragms are commercially available under the trade name "Cho Seal" for example, in a diaphragm thickness of 0.031 inch.

The housing members form respective fluid chambers 14 and 15 on opposite sides of the diaphragm 12. Fluid flow into or through each chamber is permitted by one or more ports depending upon the diaphragm position. Thus, centrally located concentric ports 16 and 17 may be provided with internal nozzle structures to be intercepted by the diaphragm 12 and thereby control fluid flow in or out of the chambers 14, 15. In some cases a flush aperture in the wall of the member may serve as a nozzle. A difference of pressure therefore in chambers 14 and 15 will cause the diaphragm to move toward one of the central ports 16, 17 and seal the nozzle. A second port 18 or 19 in the respective chambers 14, 15 is in a position that is not engaged by the flexed diaphragm 12. Thus fluid flow paths into or through the chambers 14, 15 are logically controlled by means of fluid pressure signal patterns in chambers 14, 15 on opposite sides of the diaphragm. Since these logic functions are well known, they need not be described in greater detail here. Typical fluid is air at a pressure of 80 psi for one binary signal level with atmospheric pressure providing the second binary signal level. Thus, on-off logic signals of varying signal patterns may be introduced into opposing chambers 14, 15 to effect logic results in fluid flow paths as a result of the flexing diaphragm responsive to different pressure differentials established on the entire diaphragm surface or only that portion intercepted by the internal nozzle structure of central ports 16 and 17.

Figure 2:
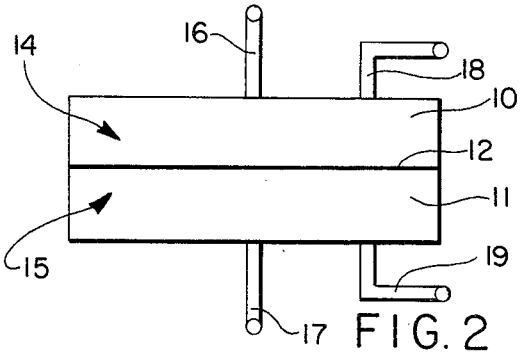
FIGS. 2 and 3 are respectively a fluid logic diagram and an electrical equivalent circuit diagram of the fluid relay logic element of FIG. 1.

Accordingly the element thus far described operates as a fluid logic element that may be schematically shown in the manner set forth in FIG. 2 to encompass varius sorts of fluid logic functions.

In accordance with the present invention, the embodiment of FIG. 1 is provided with electrical circuit switch means having electrically conductive contacts mounted in the housing structure to either engage or disengage the conductive diaphragm 12 to thereby produce a change in electric circuit continuity that may be sensed by electrical means to identify the response of the diaphragm to the fluid sources. This therefore provides a hybrid fluid-electric relay device that performs more powerful logic functions than either equivalent fluid or electric relays or isolated combinations thereof. Also the element is less expensive than conventional electromagnetic relays.

Consider the electric terminal 30 connected to the electrically conductive diaphragm 12 to be an equivalent of the transfer spring for a relay switch, that makes contact with normally closed switch contacts 31, 32 and normally open contacts 33, 34 and 35. The electrical equivalent switching circuit is set forth in FIG. 3.

Thus presume that the fluid pressure in chamber 14 flexes the diaphragm 12 into engagement with the nozzle on port 17 to close fluid flow therethrough into or out of chamber 15. The electrical switching circuit continuity will then change as follows:

1. Contact 31 will be open circuited from the conductive diaphragm so that electrical continuity from terminal 30 to contact 31 will be opened. This shows the diaphragm 12 is deflected from its normal taut condition and infers a pressure in chamber 14 greater than that in chamber 15.

2. An electrically conductive circuit will be established between terminal 30 and each of the switch contacts 33 and 34 if the diaphragm 12 is properly seated on the nozzle of port 17 in sealing position. Electrically this establishes a closed circuit between the terminals 33 and 34 by medium on the conductive diaphragm (or a conductive segment on the diaphragm if electrical isolation of contacts 33, 34 is desired). Further it establishes a conductive path between terminal 30 and each of switch contacts 33 and 34. Should the seating be weak due to leakage or improper fluid pressure conditions or the diaphragm be worn, detection might be possible by improper or intermittent switch continuity in the switching paths 30–33, 30–34 or 33–34.

3. Continuity between switch terminal 30 and switch contact 32 remains unbroken and the physical displacement of the diaphragm need not be hindered or slowed by introduction of a switch contact of this type located substantially at the outer rims of the inner chamber cylinder as shown. Should, however, wear or other failure reduce tautness of diaphragm 12, electrical sensing of contacts 31–32, 30–32 or 30–31 might become open or intermittent in the normal condition in absence of signals in chambers 14 and 15.

If a converse pressure differential in chambers 14 and 15 cause diaphragm 12 to move toward chamber 14 and close central port 16, the conditions would be as follows:

a. The conductive eyelet at port 16 can form both a nozzle and electrical contact 35 of the nature conventional in electric printed circuit boards or switch wafers, etc. Thus, continuity is established between terminal 30 and switch contact 35 when the conductive diaphragm 12 is properly seated to seal port 16.

b. Circuit continuity between terminal 30 and switch contact 32 is opened when the diaphragm is deflected into chamber 14, and continuity 30–31 remains closed.

It is noted that path 30–32 for example provides an "open before make" function of contacts 30–35 so that the aforesaid type of switching structure can afford the full equivalent of known type of electric switch logic conditions attainable simply by positioning switch contacts for reaction with the conductive flexible diaphragm as it is displaced by differential fluid pressures. The contact structures give static output indications and respond to dynamic conditions of fluid logic structures quickly changing and responding within the fluid operation times of a few milliseconds. Note also that the flexible diaphragm is an advantageous switch arm medium since it can conform to switch contact surface variations and tends to wrap itself around and wipe across a fixed contact post extending into the chambers for good electrical contact with minimized bounce and chatter characteristics. Timing advantages also may occur for example by pre-conditioning certain system portions when 30–32 is broken and before 30–35 is closed.

Figure 3:
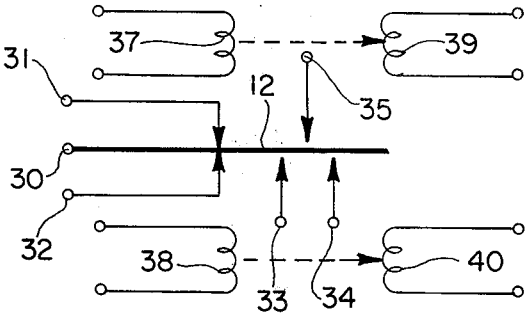

As seen in FIG. 3, which as in other Figures uses common reference characters for identification purposes, there is superimposed upon the fluid logic functions (of FIG. 2) various switching circuit functions as shown in schematic form. It is noted that the entire element is similar to an electromagnetic relay in function with two coils 37, 38 to pull the transfer switch 12 in opposite directions and provided by the fluid signal inputs to chambers 14, 15. However the dotted arrows leading to output coils 39, 40 indicate a readout function of the input signals which the fluid chambers 14, 15 permit. This readout can be either static or dynamnic and thus the equivalent electric circuit does not fully express the full range of functions possible with the hybrid fluid-electric relay element.

It is readily seen from the simple construction techniques aforesaid and functional capabilities that the element may be used as an inexpensive hybrid relay to advantage in providing one or more of (1) switching circuit outputs, (2) fluid logic functions, (3) service indications which can be electrically monitored or probed, (4) more powerful logic functions than possible with either fluid or electric relays separately, (5) electrical interfacing for fluid logic networks and if desired (6) redundant parallel functions for assuring reliability and cross checking on both static and dynamic performance.

One typical advantageous use of the elements would be in servicing fluid logic systems where the construction of elements in the manner shown adds little cost but makes available probing monitor positions for determining by electrical continuity measurements various detailed operating facts for either static or dynamic conditions encountered in a fluid logic system. Thus, the nature of malfunctions may be readily isolated.

Figure 4:
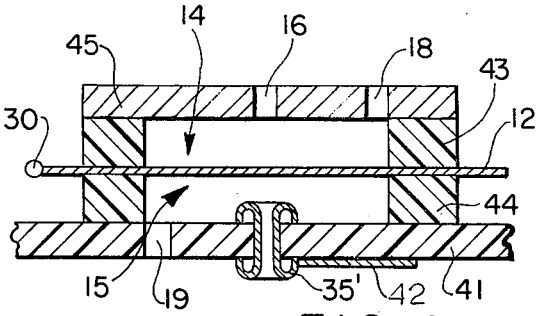
FIG. 4 is an elevation section view of a further fluid relay logic element embodiment showing the manner of construction.

Variations in construction of the elements may be used, for example those compatible with electronic printed circuits printed circuits and modular layer construction as exemplified by the embodiment of FIG. 4. Thus, the broken-off printed circuit board 41, may have a pattern of conductors 42 thereon which contact various switch contacts such as 35' to produce the required electrical circuits extending between several logic elements and conventional electric components of other types if desired.

One typical hybrid fluid-electric relay element is shown with a conductive diaphragm 12, which may be common to many such elements or isolated for each, held sandwich wise by insulating members 43, 44 on opposite sides thereof to create the chambers 14 and 15 for receiving fluid signals. In some cases one chamber, such as upper chamber 14, may be a blind chamber without an outlet port comprising solely the port 16, in which case the insulator ring or layer 43 is thin so that electrical contact is made between the conductive outer layer 45 and the diaphragm 12 if desired in normal or undeflected position. In the form shown, the diaphragm 12 may be flexed into contact with conductors 45 or 35' on opposite sides in response to fluid signals in chambers 14 and 15.

Figure 5:
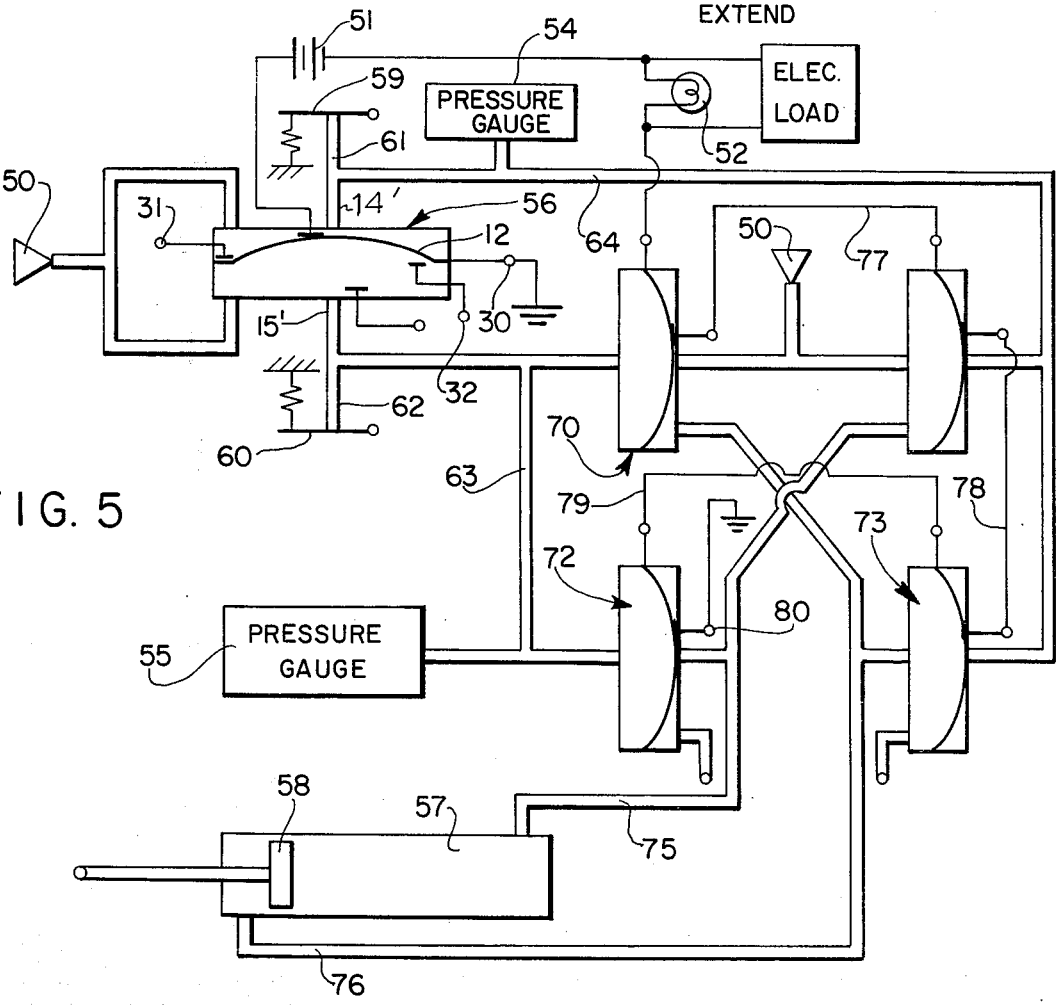
FIG. 5 is a schematic circuit diagram of a representative system of interconnected fluid relay logic elements of the type afforded by this invention.

Although there is significant advantage in each individual hybrid element, further advantages accrue in an interconnected system of such elements, which might be illustrated by the embodiment of FIG. 5. Logic interfacing to electric switching circuits, for example, permits the use of electric wiring over long distances where required to displays or further system elements, thereby meeting the fluid logic timing requirements by following the switching speeds and avoiding any R-C time delay problems of fluid lines. Also some functions can be incorporated more simply into fluid logic performance by the hybrid approach such as AND or NOT functions.

Thus, consider the simple system application of FIG. 5, showing schematically both electric and fluid logic systems superimposed for operation by the hybrid fluid-electric logic elements. The fluid power may be air at a pressure of 80 psi from a source shown in triangle convertion at 50. The electric power may be a battery as shown at 51, which indicates continuity by a lamp 52 or some other electric load 53. Pressure gage indicators 54, 55 may be used to sense the fluid flow conditions at key system monitor points such as the two output conditions of the bistable state fluid logic element 56.

The fluid system comprises a four-way valve arrangement for controlling cylinder 57 through the extend and retract cycles of piston 58 by means of fluid from source 50 under control of respective mechanical momentary venting valves 59, 60. Thus, when either of vent pipes 61 or 62 is opened by rotation against the closure springs of venting valves 59, 60, the 80 psi pressure of sorce 50 is vented and pressure is reduced in the corresponding chamber 15 or the pipeline 14' in contact with the diaphragm 12.

In the condition shown, chamber 15 and pipes 63 are at the pressure of source 50 as may be read on pressure gage 55. Conversely pressure had been previously relieved at vent valve 59 so that pressure in pipes 64 is lower as indicated by pressure gage 54. This condition is stably held until vent valve 60 is opened to reduce pressure in chamber 15 and permit diaphragm 12 to switch into position closng vent pipe 15' at such reduced pressure and permitting flow of fluid from surce 50 into piping 64 to have the source pressure established therein.

Fluid logic elements 70 to 74 in response to the state of bistable element 56 convey fluid from source 50 into one end of cylinder 57 and exhaust the opposite end. In the state shown, for example, the fluid flows from source 50 through element 71 and pipe 75 into the cylinder 57 and pipe 76 is vented by element 73. Conversely if switch 60 were opened, all diaphragms would change position and the retract cycle would result from a change of direction of fluid flow and exhaust in cylinder 57.

The corresponding electric network shown would connect through ground terminal 30 diaphragm 12, battery 51 lamp 52 wire 77, wire 78, wire 79 and grounded terminal 80 to light lamp 52 in the extend logic condition when all the diaphragms of the five fluid elements are firmly seated in flexed position. Thus, one lamp 52 can show a series of conditions or function as an AND circuit in a manner difficult to achieve with a pressure gage indicator, because of the available electric circuit connections. Also the circuit through contact terminal 30, diaphragm 12, contact 32 will produce a NOT circuit continuity indication showing the diaphragm 12 is flexed toward pipe outlet 14' and is not in normal taut position. The taut position would be shown by circuit continuity between 32 and 31.

Also note that if an electromagnetic relay were used to hold the flip-flop element 56 contacts in position, a continual power consuming source, namely solenoids would have to be used, whereas by use of fluid logic, no fluid flows from source 50 to operate logic relay 56 exceot during the changeover transition when fluid is momentarily bled out vents 61 or 62.

It is therefore evident that more logic functions can be performed and observed in simpler and more efficient manner in a hybrid system such as shown in FIG. 5 than could be done solely with electrical switching circuits or fluid logic elements. Therefore the present invention constitutes an advance in the art which provides more efficient operation in a different mode than heretofore available.

What is claimed is:

1. A logic system comprising in combination, at least one pneumatic logic element with a housing retaining a flexible elastic diaphragm having at least a surface portion thereof electrically conductive centrally disposed between two chambers respectively for receiving fluid under different pressures thereby to flex said diaphragm toward at least one chamber in response to said pressure differences of the fluid in said chambers on opposite sides of the diaphragm, means presenting a fluid flow path into each of said chambers to introduce different fluid sources of differing pressure patterns respectively into said two chambers, means presenting an output fluid flow from one of said chambers controlled by positioning of said diaphragm, and switch means with an electrical contact mounted in at least one chamber for conductive contact relationship with said diaphragm in said centrally disposed position to provide a closed set of contacts that changes to an open set of contacts in a flexed diaphragm position into one of said chambers in response to greater fluid pressure on the side said diaphragm presenting said closed set of contacts produced by fluid flow into said two chambers to thereby produce a change in electrical circuit continuity between said diaphragm and said contact that may be sensed by an electrical means to identify the response of the diaphragm to said different fluid sources.

2. A system as defined in claim 1 including a printed circuit board having electrical terminals thereon, wiring on said board, and mounting structure on said board for positioning said logic element thereon so that the board constitutes a chamber wall confining fluid with said diaphragm flexible into the chamber wall to engage in conductive contact with said electrical terminals on the printed circuit board.

3. A system as defined in claim 1 wherein one said logic element has an input and output fluid flow path in each said compartment only one of which is blocked by the diaphragm in a flexed position responsive to a differential of pressure in the two compartments.

4. A system as defined in claim 3 wherein the switch means comprises two contacts respectively opening and closing continuity paths upon flexing of the diaphragm into a predetermined one of said compartments.

5. In a logic system comprising a plurality of fluid logic elements of the taut flexible elastic diaphragm type, wherein the diaphragm separates two compartments which receive fluid under pressure and through one compartment of which is defined a fluid flow path that may be selectively closed by means of differential pressure on said diaphragm deflecting the diaphragm toward the said one compartment, said elements being interconnected in a coacting system with a fluid source producing fluid flow paths between said elements to produce different patterns of deflected diaphragm positions within the two compartments of the elements, the improvement comprising, electrical circuit switch logic means comprising in at least two different elements a set of electrical contacts one contact in each set of which comprises said diaphragm whereby the set is cooperatively actuated by said fluid source upon deflection of said diaphragms in a direction opposite that of the higher fluid pressure in said two compartments in said at least two different elements, and an electrical circuit connected through the contact sets in said two different elements thereby operably changing electrical continuity in one said set of electrical contact terminals electrically connected together to provide by at least one pattern of diaphragm positions an electrical continuity circuit path connected by flexing of said diaphragms.

6. A logic system as defined in claim 5 including a closed electric circuit through an electrical contact engaging said diaphragm in electrically conductive embracement in unflexed position and positioned to disengage said diaphragm when it is in flexed position urged toward one of said chambers thereby opening said closed electric circuit.

7. A system as defined in claim 5 wherein said circuit path comprises a series path through at least two logic elements, thereby constituting a logic AND circuit.

8. A system as defined in claim 5 wherein said circuit path includes at least one continuity path that is closed for one position of a logic element diaphragm and opened for another position of the same logic element diaphragm to thereby constitute a logic NOT circuit.

9. A logic system comprising in combination, at least one pneumatic logic element with a housing retaining a flexible elastic diaphragm between two chambers respectively for receiving fluid under different pressures thereby to flex said diaphragm toward at least one chamber in a direction opposite to that chamber with highest pressure in response to said pressure differences in said chambers on opposite sides of the diaphragm, the diaphragm comprising a conductive member having at least a surface portion thereof electrically conductive, and at least one said chamber having a fluid flow path therethrough controlled by said diaphragm to block flow between inlet and outlet fluid ports, and electrical contact means located in said housing for cooperative electrical engagement with the conductive diaphragm member for thereby changing the conductivity of an electric circuit in response to presence of fluid flow between said inlet and outlet ports.

10. A pneumatic logic element with a housing retaining a flexible elastic electrically conductive diaphragm held between two chambers, port means passing fluid under pressure with differing pressure characteristics into each respective chamber to deflect said diaphragm to that chamber opposite the chamber having higher fluid pressure as a function of pressure differentials on opposite sides thereof, fluid flow output means from at least one chamber providing a path for passing fluid from said port means through said chamber, means closing said path through said chamber in response to deflection of said diaphragm, and electrical contacts arranged in said chambers to indicate by conductivity with said diaphragm closure of said fluid path.

* * * * *